US010099900B2

(12) United States Patent
Miller

(10) Patent No.: US 10,099,900 B2
(45) Date of Patent: Oct. 16, 2018

(54) CLAMP DEVICE FOR LIFTING EQUIPMENT AND OTHER ITEMS TO AN ELEVATED POSITION

(71) Applicant: Mechanical Devices Company, Bloomington, IL (US)

(72) Inventor: Paul Miller, Lexington, IL (US)

(73) Assignee: Mechanical Devices Company, Bloomington, IL (US)

( * ) Notice: Subject to any disclaimer, the term of this patent is extended or adjusted under 35 U.S.C. 154(b) by 0 days.

(21) Appl. No.: 15/829,318

(22) Filed: Dec. 1, 2017

(65) Prior Publication Data

US 2018/0079627 A1 Mar. 22, 2018

Related U.S. Application Data

(62) Division of application No. 15/088,338, filed on Apr. 1, 2016, now Pat. No. 9,862,577.

(51) Int. Cl.
*B66C 1/34* (2006.01)
*B66D 3/26* (2006.01)

(52) U.S. Cl.
CPC . *B66C 1/34* (2013.01); *B66D 3/26* (2013.01)

(58) Field of Classification Search
CPC ..... B66C 1/34
USPC ..... 294/82.1, 82.11, 82.13, 82.14, 82.17, 294/82.23; 24/598.8, 598.9, 599.8, 600.7, 24/600.8; 59/93
See application file for complete search history.

(56) References Cited

U.S. PATENT DOCUMENTS 1,433,616 A * 10/1922 Helden ..... B66C 1/34 248/321
1,522,733 A * 1/1925 Lapadula ..... E02F 3/6463 37/436
1,671,435 A * 5/1928 McKissick ..... B66D 3/046 254/402
1,713,586 A * 5/1929 Wright ..... B66D 3/06 254/404
2,032,764 A * 3/1936 Otte ..... B66D 3/04 254/415
2,384,497 A * 9/1945 Siler ..... B66C 1/34 294/74
2,433,938 A * 1/1948 Varner ..... B66C 1/06 191/1 R
3,083,993 A 4/1963 Damm
3,289,258 A 12/1966 Eriksson
3,583,751 A 6/1971 White et al.
3,911,671 A 10/1975 Guillen
(Continued)

OTHER PUBLICATIONS

Photos of clamp device being used on wind tower each of Bloomington, Illinois; Apr. 12, 2013.

*Primary Examiner* — Paul T Chin
(74) *Attorney, Agent, or Firm* — Husch Blackwell LLP

(57) ABSTRACT

A clamp device for lifting equipment from a first position to a second elevated position. The present device includes a body member and a clamping member. A cord, cable or rope may be received within the body member and secured therein when the clamping member is attached thereto. Eyelets located on the body member may be used to attach various equipment and supplies thereto. A wench or other hoisting device may be used to raise the cord, cable or rope associated with the present clamp device and the equipment attached thereto to an elevated position.

4 Claims, 4 Drawing Sheets

(56) References Cited

U.S. PATENT DOCUMENTS

| | | | | | |
|---|---|---|---|---|---|
| 3,984,899 | A | | 10/1976 | Northe | |
| 4,398,387 | A | | 8/1983 | Bary | |
| 4,569,548 | A | | 2/1986 | Vaders | |
| 4,669,618 | A | | 6/1987 | Brand | |
| 4,709,952 | A | | 12/1987 | Selby | |
| 4,785,509 | A | * | 11/1988 | Fisher | B63B 21/54 114/230.3 |
| 4,818,004 | A | * | 4/1989 | Oswalt | B66C 1/10 294/67.21 |
| 5,476,247 | A | * | 12/1995 | Melder | B66D 3/04 254/401 |
| 5,979,954 | A | * | 11/1999 | Tsui | B66C 1/66 294/215 |
| 6,908,074 | B2 | * | 6/2005 | Eiwan | B66D 3/043 254/390 |
| 7,000,292 | B2 | | 2/2006 | Beaudoin et al. | |
| 8,602,468 | B2 | | 12/2013 | Kutsen | |
| 9,862,577 | B2 | * | 1/2018 | Miller | B66C 1/34 |
| 2015/0145267 | A1 | | 5/2015 | Robins | |

* cited by examiner

CLAMP DEVICE FOR LIFTING EQUIPMENT AND OTHER ITEMS TO AN ELEVATED POSITION

CROSS REFERENCE

This application is a divisional application of application Ser. No. 15/088,338 filed Apr. 1, 2016, the entire disclosure of which is incorporated herein by reference.

BACKGROUND OF INVENTION

The present invention relates to a device for lifting equipment and other items from a first position to a second elevated position and, more particularly, to several embodiments of a clamp device able to selectively receive and engage chains, cables, or ropes for lifting equipment, tools, and other items to an elevated position.

Workers and recreationalists alike often need to raise equipment from a first position, such as a ground position, to a second elevated position. For example, workers in wind towers often need to hoist tools, equipment and other supplies from the base of the wind tower to the top of the tower. Hand carrying supplies to the top of the wind tower while physically climbing a ladder is inefficient, tiring and can be dangerous. Similarly, hunters often need to hoist hunting equipment such as firearms, ammunition, back packs and scoping apparatus to the top of a deer stand or other elevated structure. Window washers and workmen also frequently need supplies hoisted to scaffolding at a higher building story to clean windows or to make other repairs. A simple, easy to attach clamping device for hoisting equipment to an elevated position can therefore be readily used in a lot of different applications.

There are some existing specialized devices that allow tools and other equipment to be attached to the bottom of a chain such that when a wench or other hoist or lifting mechanism is activated, the chain and the equipment attached to the bottom of the chain can likewise be hoisted to the elevated position. However, these devices are only able to be attached to the bottom or last link of the chain. As such, only one hoisting device can be attached to the chain. Thus, whenever equipment is raised to an elevated position, a full stroke of the chain is required, thus placing a high burden on the hoisting device or the individual hoisting the equipment to the elevated position. The existing devices also only have one hook attached to their lower end portion, so hoisting additional equipment requires multiple hoisting operations, thus increasing the time required to hoist a plurality of items to the elevated position.

Existing devices are also often complicated to assemble, and require a wrench and other hardware such as screws and nuts to attach and assemble the unit onto a chain. The screws and nuts associated with the existing devices are easily lost on a job site when the existing devices are attached and unattached to the chain. In addition, the known available devices for lifting equipment to an elevated position are for use only with a steel chain such as those commonly used and long understood in the field. These devices are not adapted to be used with rope, cable, or other cord type members. The known existing devices for hoisting equipment to an elevated position are neither efficient nor versatile.

It is therefore desirable to have a clamping device for lifting equipment and other items to an elevated position that is more efficient and versatile than existing devices, that can be attached at any intermediate location on the chain or other hoisting member, and that is still able to securely raise equipment to an elevated position.

Accordingly, the present invention is directed to a clamp device which overcomes one or more of the problems set forth above.

SUMMARY OF THE INVENTION

The present invention is a clamp device for lifting equipment and other supplies from a first position to a second elevated position. The clamp device may be used by professionals and recreationalists alike to raise equipment to any elevated positions such as to the top of wind towers, scaffolding, deer stands, and so forth including mountain climbing applications, merchandising display applications and more.

One embodiment of the present clamp device includes a body member and a door member, the door member being hingedly attached to the body member via a hinge pin. The body member preferably includes eyelets extending from its opposed side portions. Equipment and other supplies to be raised to an elevated position can be attached to the eyelets of the body member before being hoisted using a wench or other lifting mechanism.

The interior portion of the body member preferably includes an engagement mechanism which is embodied, in one embodiment, by two pin members or projection members protruding from an interior portion of the body member. Openings in the link members of a chain member are positioned to receive the projection members. The interior portion of the body member also includes various cavities or recesses for receiving the link members located adjacent to the link members of the chain received by the projection members. Similarly, the door member includes a plurality of corresponding cavities or recesses for receiving the same link members positioned within the engagement mechanism of the body member. The door member also includes holes or openings for receiving both the hinge pin member and a locking pin member as explained below. The various cavities or recesses of the body member and the door member allow the door member to be closed in a flush orientation when the various chain link members are positioned in operative arrangement within the body member.

When the door member is closed and an operator is ready to lock the door member to the body member in anticipation of raising equipment or other supplies to an elevated position, an opening in the door member aligns with openings in the body member such that a locking pin member attached to the body member may be inserted through these aligned openings to lock the door member in its closed position to the body members. The locking pin also includes a latching mechanism that includes a latching receiver that is able to receive a portion of the locking pin extending through the body member such that the locking pin is securely locked and can be maintained in its locked position.

A second embodiment of the present clamp device is specifically designed for attaching to a cord, cable or rope type member and includes a body member and a clamping member. The body member includes a trough, recess or cavity adapted to receive the cable, cord or rope type member therewithin and the clamping member includes a locking or wedging mechanism for holding the cord, cable or rope type member within the body member. The clamping member is designed to be positioned within the trough or recess associated with the body member and its locking mechanism is designed to apply a sufficient force to the cord, cable or rope type member so as to securely hold that member between the body member and the clamping member. An eyelet is likewise located on the body member for attaching equipment and other supplies to the eyelet for lifting such equipment to an elevated position.

These and other objects and advantages of the present invention will become more apparent to those skilled in the art after consideration of the following specification taken in conjunction with the accompanying drawings.

BRIEF DESCRIPTION OF THE DRAWINGS

For a better understanding of the various embodiments of the present invention, reference may be made to the accompanying drawings in which.

DETAILED DESCRIPTION OF THE INVENTION

Figure 1:
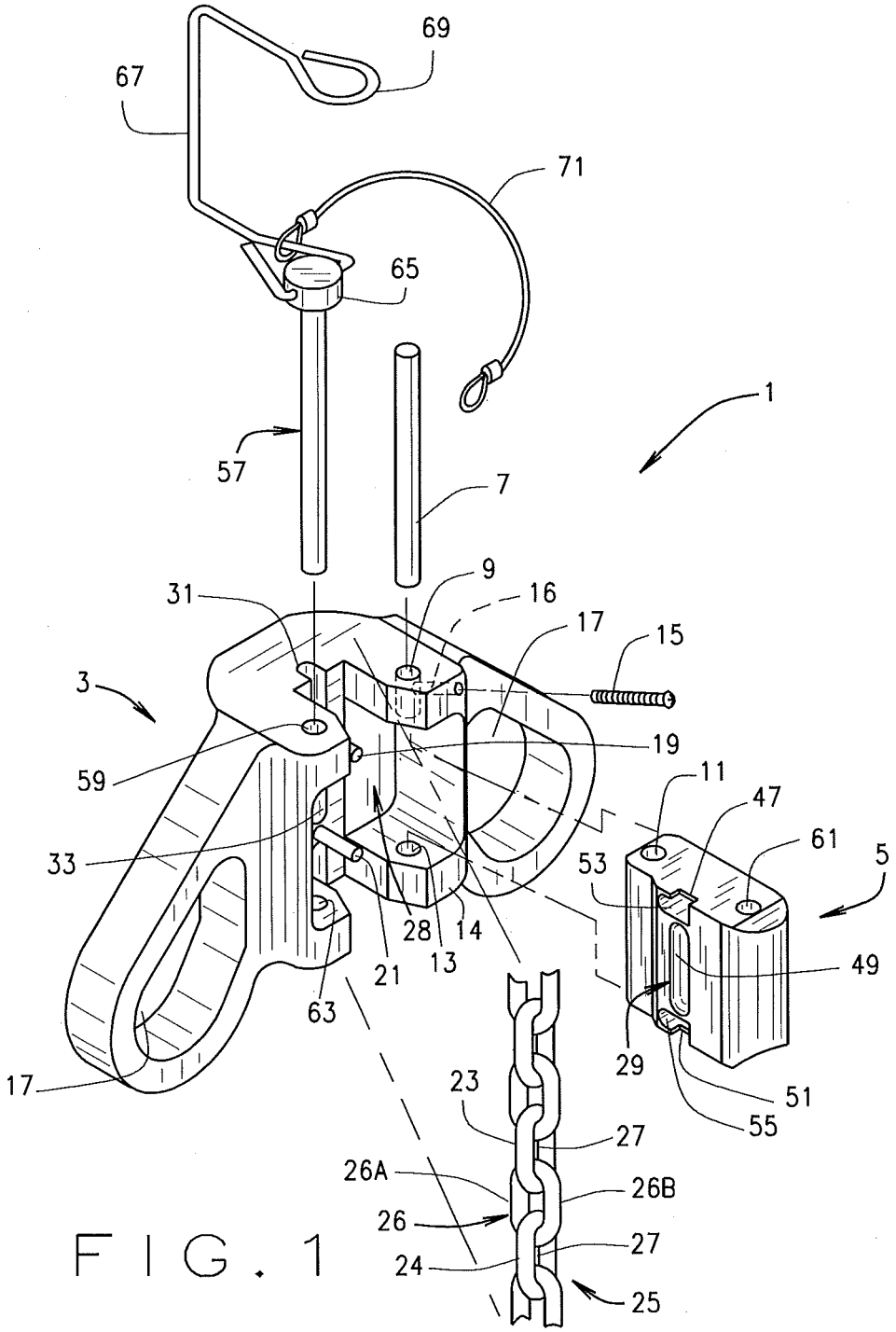
FIG. 1 is an exploded perspective view of one embodiment of the present clamp device for lifting equipment and other items to an elevated position constructed according to the teachings of the present invention.
Figure 6:
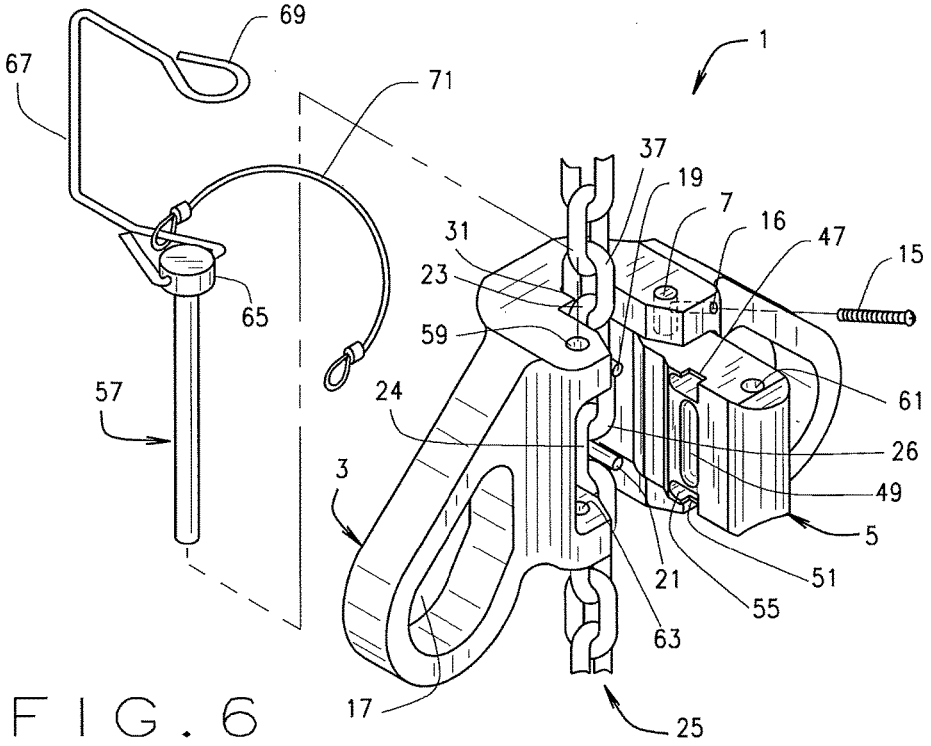
FIG. 6 is an exploded perspective view of the clamp device of FIGS. 1-5 with the door member open and wherein the body member has received a chain member.
Figure 7:
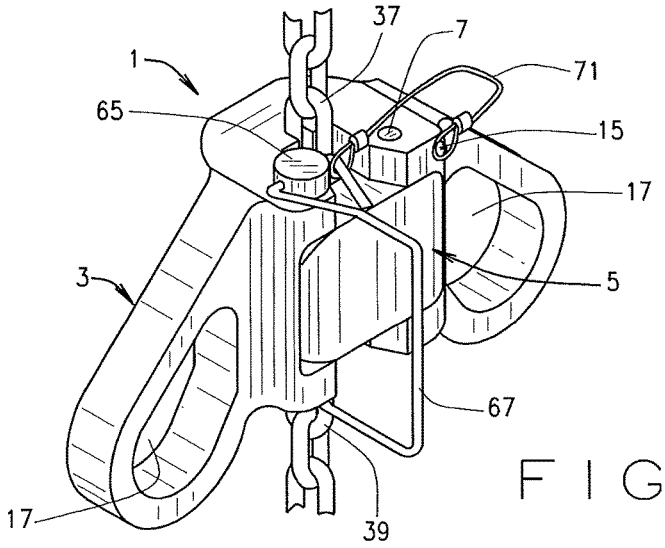
FIG. 7 is a perspective view of the clamp device of FIG. 6 wherein the door member is closed and the present clamp device has received and engaged the chain member of FIG. 6.

FIG. 1 illustrates an exploded perspective view of one embodiment of a clamp device for lifting equipment and other items to an elevated position constructed in accordance with the teachings of the present invention. Clamp device 1 preferably includes a body member 3 and a door member 5, which are hingedly attached to one another via a hinge pin 7. Hinge pin 7 is insertable through a first body member hole or opening 9, through a door member hole or opening 11 that extends through the entire length of door member 5, and through a second partial body member hole or opening 13 as best illustrated in FIGS. 1, 6 and 7. Opening 13 does not extend all the way through the lower body portion 14 but stops short of exiting body portion 14 thereby forming a shelf or ledge for stopping and holding hinge pin 7 in place within openings 9, 11 and 13.

Figure 2:
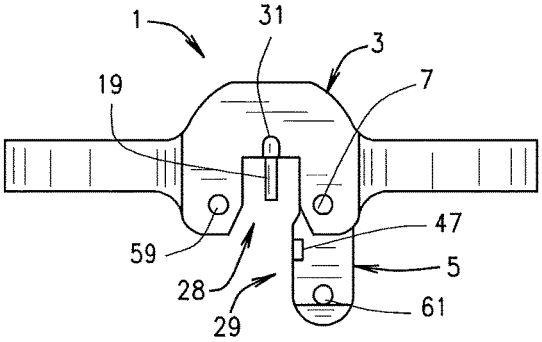
FIG. 2 is a top plan view of the clamp device of FIG. 1.
Figure 3:
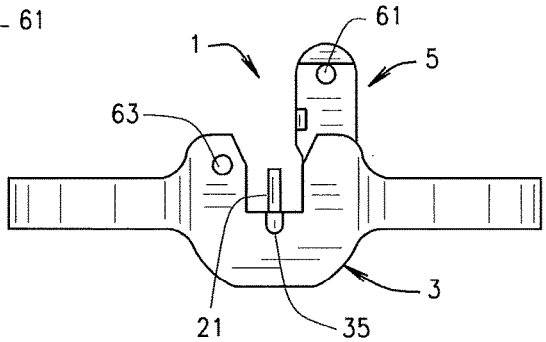
FIG. 3 is a bottom plan view of the clamp device of FIGS. 1 and 2.

Hinge pin 7 rests within opening 13 and is preferably secured within holes 9, 11, 13 of body member 3 and door member 5 by way of fastener 15 which extends through an opening or hole 16 that registers with and communicates with hole 9. The force of fastener 15 against hinge pin member 7 holds pin member 7 in its proper operative position. Other means for securing hinge pin 7 within body member 3 and door member 5 such as a friction fit, a bracket mechanism, a flared end portion or other foreseeable means are likewise contemplated and can be utilized to accomplish this task. FIGS. 2 and 3 illustrate top and bottom plan views, respectively, of door member 5 being attached to body member 3 via hinge pin 7.

Figure 4:
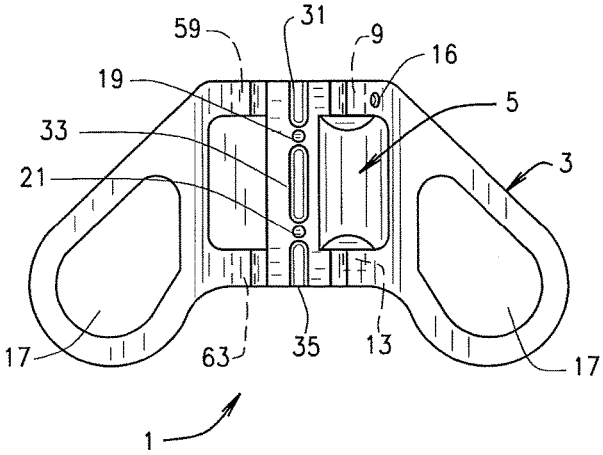
FIG. 4 is a front elevational view of the clamp device of FIGS. 1-3.
Figure 5:
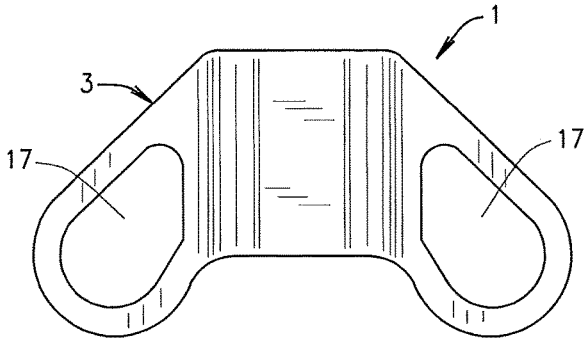
FIG. 5 is a rear elevational view of the clamp device of FIGS. 1-4.

FIGS. 4 and 5 illustrate body member 3 in greater detail. As shown in FIGS. 4 and 5, and also in FIGS. 1 and 6, body member 3 includes eyelets 17 extending from each of its opposed side positions. Equipment and other supplies to be hoisted to an elevated position may be releasably attached to eyelets 17, for example, by using carabiners or otherwise tying or clasping equipment to eyelets 17. A nearly limitless number of mechanisms are available for attaching equipment and other supplies to eyelets 17 of body member 3.

Body member 3 further includes an engagement mechanism associated with its interior portion 28 for securely engaging a chain member within body member 3. In clamp device 1 illustrated in FIGS. 1-7, body member 3 includes a pair of projection members 19, 21 which act as engagement members for receiving link members 23 and 24 of a chain member 25. Link members 23 and 24 are spaced apart link members separated by link member 26 located therebetween, and each include an opening 27 which is able to receive a projection member 19 or 21 as best illustrated in FIGS. 1 and 6. In this regard, link members 23 and 24 lie flat within body member 3 such that the projection members 19, 21 can extend through the respective openings 27. This orientation positions link member 26 on edge such that one of the link member side portions 26A or 26B will lie in a middle link receiver recess 33 as will be hereinafter further explained. Corresponding receiver recesses are also associated with door member 5 as will likewise be hereinafter explained.

As shown in FIG. 1 and more clearly illustrated in FIG. 4, body member 3 includes a first or upper link receiver recess or cavity 31, a second or middle link receiver recess or cavity 33, and a third or lower link receiver recess or cavity 35, all of which are cavities, recesses or cut-outs in body member 3. FIG. 6 illustrates body member 3 and projection members 19, 21 having received openings 27 of link members 23 and 24 and further illustrates receiver recesses 31, 33, 35 engaged with link members 37, 26 and 39 respectively. Link members 37 and 39 are located adjacent to link members 23 and 24 respectively and are likewise positioned on edge such that one of their side portions lie in upper and lower receiver recesses 31 and 35 respectively. Similarly, interior portion 29 of door member 5 includes a corresponding first or upper link receiver recess 47, a second or middle link receiver recess 49, and a third or lower link receiver recess 51 for receiving link members 37, 26 and 39 respectively. Recesses 47, 49, and 51 together with recesses 31, 33, 35 allow door member 5 to close in a flush orientation with the front surface of body member 3, with link members 37, 23, 26, 24 and 39 of chain member 25 being positioned and located between door member 5 and body member 3. FIG. 6 also illustrates receiver recesses 47, 49 and 51 of door member 5 about to receive and engage link members 37, 26 and 39.

When body member 3 has received chain member 25 in the manner illustrated in FIG. 6 and explained above, door member 5 may be closed about its hinge pin 7 as shown in FIG. 7. Projection recesses 53, 55 of door member 5 are positioned and located to receive projection members 19, 21 of body member 3 as the door member is closed. As shown in FIGS. 1 and 6, recesses 53, 55 are elongated both laterally and along the width of door member 5 so that as door member 5 is closed, projection members 19, 21 have clearance to slide along and through recesses 53, 55 and rest therewithin when door member 5 is fully closed. Also, recesses 53 and 55 are co-extensive with door recesses or cutouts 47 and 51 and therefore door recesses 47, 53 and 51, 55 can be integral with each other as illustrated. It is also recognized and anticipated that the recesses 47, 53, 51 and 55 can likewise be positioned and located within door member 5 so as to be separate individual recesses.

A locking pin 57 is illustrated in FIGS. 1 and 6 in its unengaged position. When door member 5 is closed, locking pin 57 may be inserted through a first locking pin hole 59 of body member 3, a door member hole 61 which extends through the length of door member 5, and a second locking pin hole 63 of body member 3, all three holes or apertures 59, 61, 63 being in substantial alignment with one another when door member 5 is closed. Locking pin 57 extends through holes 59, 61, 63.

Once extended through openings 59, 61, 63, a head member 65 of locking pin 57 preferably abuts locking hole 59 such that locking pin 57 does not completely slide through hole 59 or holes 61, 63 therebelow. A portion of locking pin 57 may extend through second locking pin hole 63 (not illustrated). A latching mechanism 67 attached to head member 65 of locking pin 57 may be rotated downwardly such that a locking pin receiver member 69 associated with latching mechanism 67 is able to receive and engage that portion of locking pin 57 extending through second locking pin hole 63. This attachment is accomplished in a conventional manner.

FIG. 7 illustrates latching mechanism 67 rotated downwardly such that locking pin receiver member 69 has received and engaged the unillustrated portion of locking pin 57 extending through hole 63. This engagement further secures locking pin 57 within the openings 59, 61 and 63. As shown in FIGS. 1, 6, and 7, a lanyard member 71 may be attached at one end to latching mechanism 67 and at its other end to body member 3 by way of fastener 15. In alternative embodiments, a different means for securing lanyard member 71 to either of latching mechanism 67 or body member 3 are contemplated and envisioned. Lanyard member 71 helps to prevent locking pin 57 and latching mechanism 67 associated therewith from getting lost at a job site when clamp device 1 is used frequently and is repeatedly attached to and detached from a chain such as chain member 25.

Because of the construction of body member 3 and door member 5, the present clamp device 1 can be attached at any location along chain member 25. In this regard, since chain member 25 has numerous link members, any intermediate link members corresponding to link members 23, 24, 26, 37 and 39 can be inserted into body member 3 as previously described. This means that multiple clamp devices 1 may be attached to a single chain member 25 and all such clamp devices can be loaded with equipment and hoisted all at once. When a single clamp device 1 or multiple clamp devices 1 have been attached to a chain member, a wench or other hoist device utilized for pulling the chain member may be used to raise the chain member and the attached clamp devices to a higher elevated position. When clamp devices 1 are raised, any equipment, tools or other supplies that are attached to eyelets 17 are similarly raised to the elevated position.

Although the engagement mechanism associated with body member 3 has been described as a pair of projection members 19 and 21, it is likewise recognized and anticipated that the engagement mechanism will work equally as well with at least one projection member 19 or 21. In this arrangement, the interior portion of body member 3 would be configured so as to eliminate the second or middle link receiver recess 33 such that only one of the link members 23 or 24 would lie flat within the interior portion 28 of body member 3. In all other respects, body member 3 would be substantially identical to that disclosed above. In similar fashion, the interior portion 29 of door member 5 would be redesigned to eliminate the corresponding middle link receiver recess 49 and one of the two corresponding projection receiver recesses 53 or 55. Only a single projection receiver recess would be incorporated into door member 5. In all other respects, door member 5 would likewise function and operate as described above.

Also, depending upon the type and size of chain member 25 utilized in conjunction with the present clamp device 1, the interior portions 28 and 29 of body member 3 and door member 5 can be sized and dimensioned to accommodate the size of the particular chain member to be used with the present claim device 1.

Figure 8:
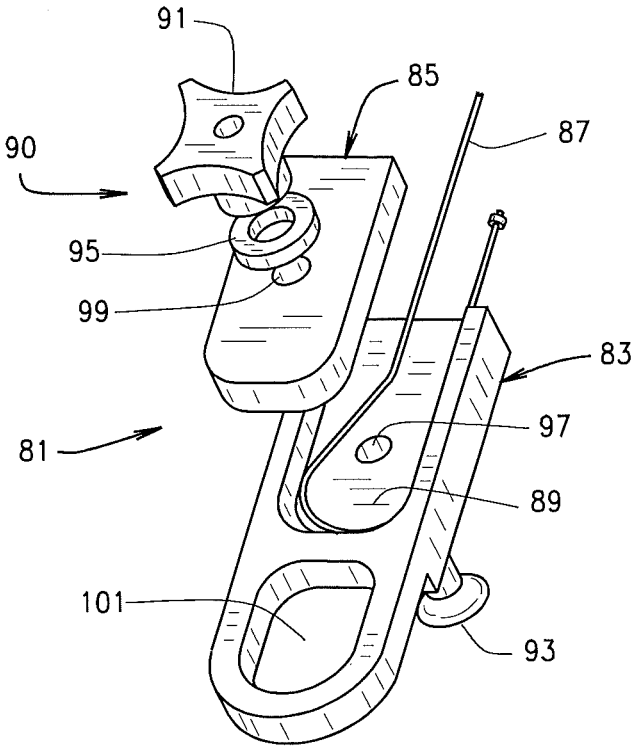
FIG. 8 is an exploded perspective view of a second embodiment of a clamp device for lifting equipment and other items to an elevated position.

FIG. 8 illustrates another embodiment 81 of the present clamp device for lifting equipment, tools and other supplies from a first position to a second elevated position. Clamp device 81 is specifically designed for attaching to and accommodating a cord type member such as a rope or cable and preferably includes a body member 83 and a clamping member 85. Body member 83 includes a trough, recess, cavity or cutout 89 and clamping member 85 includes a locking or wedging mechanism 90. A cord type member such as cable member 87 may be used with clamp device 81 in a similar fashion as described above to raise equipment and other supplies to an elevated position. This is accomplished by placing cable 87 in the trough or cavity 89 of body member 83 and thereafter positioning the clamping member 85 within the trough 89 on top of cable 87 to secure the cable therebetween. This wedging or clamping action is achieved through locking mechanism 90.

In this regard, locking mechanism 90 includes turn knob 91 and a flat head screw or other suitable threaded fastener 93 which function together to apply a sufficient clamping force to securely hold the cable 87 wedged between members 83 and 85 thereby preventing cable 87 from slipping or disengaging from the clamp device 81 during a lifting operation. Fastener 93 is preferably countersunk so that it does not project from the rear portion of body member 83 and it is insertable through apertures 97, 99 in members 83 and 85 respectively as best illustrated in FIG. 8. Apertures 97 and 99 are positioned in registration with each other when clamping member 85 is positioned within recess 89. Other means for securely engaging clamping member 85 to body member 83 are also envisioned and anticipated. The interior portion of turn knob 91 is correspondedly threaded such that as turn knob 91 is rotated, it correspondingly threads or unthreads fastener 93 to turn knob 91. A washer 95 may also be inserted between turn knob 91 and clamping member 85 for providing a more secure engagement between body member 83 and clamping member 85.

As illustrated in FIG. 8, the cable or rope 87 may be looped or coiled within trough 89 one or more times to increase the gripping capability between members 83 and 85 depending upon the type of cable or rope being used and the weight of the particular load to be hoisted to the elevated position. As the turn knob 91 is threaded onto the fastener 93, a clamping force is generated between clamping member 85 and body member 83.

Body member 83 also includes at least one eyelet 101 to which equipment and other supplies may be attached before being raised to an elevated position. The manner in which equipment is attached to eyelet 101 and the manner in which clamp device 81 is raised to an elevated position is substantially similar to the operation and use of clamp device 1 and its associated eyelets 17 as previously described.

Figure 9:
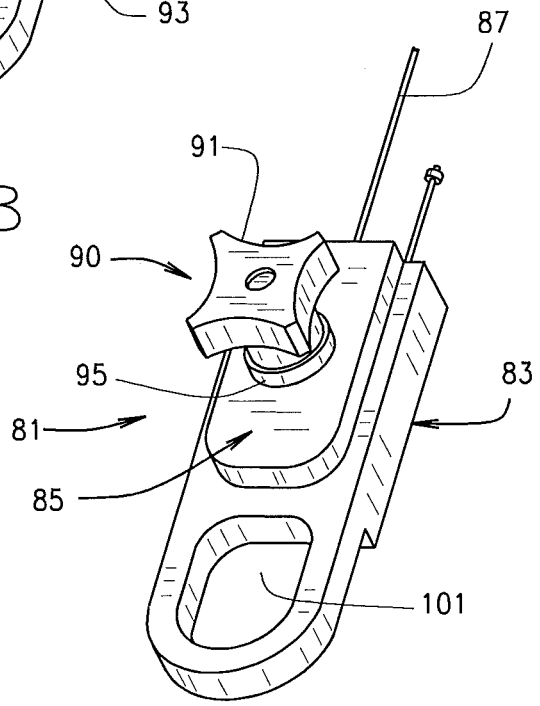
FIG. 9 is a perspective view of the clamp device of FIG. 8 in its closed and clamped position.

FIG. 9 illustrates clamp device 81 in its fully assembled condition with cable 87 clamped between members 83 and 85. It should be noted that, like clamp device 1, multiple clamp devices 81 may likewise be attached to a single cable 87 in series at intermediate locations along the length of the cable 87 by merely attaching a plurality of clamp devices 81 at spaced locations along the length of cable 87 as described with respect to FIG. 8 to accommodate the equipment to be hoisted to the elevated position as previously explained. The size and dimensions of clamp device 81 including the trough or recess 89 and the corresponding clamping member 85 can vary depending upon the type of cord, cable or rope being utilized with the present clamp device 81.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

Thus, there has been shown and described several embodiments of a novel clamp device for lifting equipment and other items to an elevated position. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required".

Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A clamp device for lifting equipment and other items from a first position to an elevated second position, the clamp device comprising:

a body member having a recess associated therewith, said recess being sized and shaped to receive a cord type member, said body member including at least one eyelet;

a clamping member sized and shaped to fit within said recess, the clamping member resting on the cord type member and wedging the cord type member between the clamping member and the recess;

a locking mechanism for holding and locking the cord type member in a fixed position between said body member and said clamping member as an item is lifted from the first position to an elevated second position.

2. The clamp device of claim 1 wherein said locking mechanism includes a threaded fastener engageable with a turn knob, turning said turn knob applying a sufficient clamping force between said clamping member and said body member for securely holding a cord type member positioned therebetween in a fixed position.

3. The clamp device of claim 2 further including a first opening extending through the recess of said body member and a second opening extending through said clamping member, said first and second openings lying in registration with each other when said clamping member is positioned within said recess, said fastener extending through said first and second openings and being threadedly engageable with said turn knob.

4. The clamp device of claim 1 wherein said recess is sized and shaped so that a cord type member can be looped or coiled within said recess.

* * * * *